US008207495B2

(12) United States Patent
Mukaibatake et al.

(10) Patent No.: US 8,207,495 B2
(45) Date of Patent: Jun. 26, 2012

(54) QUADRUPOLE MASS SPECTROMETER

(75) Inventors: Kazuo Mukaibatake, Kyoto (JP); Daisuke Okumura, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 318 days.

(21) Appl. No.: 12/373,958

(22) PCT Filed: Oct. 11, 2006

(86) PCT No.: PCT/JP2006/320267

§ 371 (c)(1),
(2), (4) Date: Jan. 15, 2009

(87) PCT Pub. No.: WO2008/044285

PCT Pub. Date: Apr. 17, 2008

(65) Prior Publication Data

US 2010/0012836 A1 Jan. 21, 2010

(51) Int. Cl.
*H01J 49/26* (2006.01)
*H01J 49/36* (2006.01)

(52) U.S. Cl. ..... 250/283; 250/281; 250/290

(58) Field of Classification Search ..... 250/281, 250/282, 283, 290, 291, 292, 293, 294, 296, 250/297

See application file for complete search history.

(56) References Cited

U.S. PATENT DOCUMENTS 3,735,287 A * 5/1973 Lowe ..... 331/106
2003/0034451 A1* 2/2003 Whitehouse et al. ..... 250/288
2004/0124353 A1* 7/2004 Tanner et al. ..... 250/288
2004/0238755 A1* 12/2004 Lee et al. ..... 250/423 R
2006/0169890 A1* 8/2006 Crawford et al. ..... 250/290
2010/0019143 A1* 1/2010 Dobson et al. ..... 250/283

FOREIGN PATENT DOCUMENTS

JP 48-011089 A 2/1973
JP 59-060856 A 4/1984
JP 07-240171 A 9/1995
JP 08-293282 A 11/1996
JP 11-025904 A 1/1999

OTHER PUBLICATIONS

Written Opinion of the International Searching Authority dated Dec. 26, 2006, issued in corresponding International application No. PCT/JP2006/320267.

* cited by examiner

*Primary Examiner* — David A Vanore
*Assistant Examiner* — Nicole Ippolito
(74) *Attorney, Agent, or Firm* — Sughrue Mion, PLLC

(57) ABSTRACT

The direct current bias voltage to be applied to the pre-filter provided in the previous stage of the quadrupole mass filter for selecting an ion according to the mass-to-charge ratio is changed in accordance with the mass-to-charge ratio of the target ion to be allowed to pass through, in order that the time period required for an ion to pass through the pre-filter is uniformed regardless of the mass-to-charge ratio, and simultaneously the phase of the oscillation of ions at the entrance of the quadrupole mass filter is also uniformed. In the range where the mass-to-charge ratio is larger than some degree, the ion's oscillation itself is small, and in addition, the ion's passage efficiency deteriorates rather than enhances, due to the potential barrier created by the voltage difference from the direct current bias voltage applied to the quadrupole mass filter.

4 Claims, 4 Drawing Sheets

QUADRUPOLE MASS SPECTROMETER

TECHNICAL FIELD

The present invention relates to a quadrupole mass spectrometer using a quadrupole mass filter as a mass separator for separating ions in accordance with their mass-to-charge ratio.

BACKGROUND ART

A quadrupole mass spectrometer using a quadrupole mass filter in a mass separator for separating ions in accordance with their mass-to-charge ratio has been widely known as a type of mass spectrometer. Typical quadrupole mass filters are composed of four cylindrical rod electrodes disposed substantially parallel to each other in such a manner as to surround the ion optical axis C. A voltage of $\pm(U+V\cdot\cos\omega t)$ is applied to each of the four rod electrodes, in which a direct current voltage U and a radio-frequency voltage $V\cdot\cos\omega t$ are superimposed. This voltage forms a radio-frequency electric field and a direct current electric field in the space surrounded by the four rod electrodes. Consequently, only an ion having a specific mass-to-charge ratio is selectively allowed to pass through, and other unnecessary ions are dispersed along the way.

In one known configuration of such a quadrupole mass spectrometer, a pre-filter, which is normally shorter than a main rod electrode, is provided in the previous stage of the four main rod electrodes which compose a quadrupole mass filter (refer to Patent Documents 1 and 2 or other documents). Although a pre-filter is sometimes called a pre-rod or the like, in this specification, it is called a pre-filter as a whole, and each electrode is called a pre-rod electrode. FIG. 7 illustrates the schematic diagrams of a pre-filter 13 and a quadrupole mass filter 14: (a) is an arrangement diagram on a plane including an ion optical axis C, and (b) is an arrangement diagram on a plane orthogonal to the ion optical axis. The main objective of the pre-filter 13 is to increase the ion's passage ratio and mass resolution. Generally, the application of the voltage is controlled in the following manner: to the main rod electrodes which compose the quadrupole mass filter 14, a voltage of $Vbias\mathbf{1}\pm(U+V\cdot\cos\omega t)$ is applied in which a direct current bias voltage Vbias is further added to the aforementioned voltage. On the other hand, to the pre-rod electrodes which compose the pre-filter 13, a voltage of $Vbias\mathbf{2}\pm V\cdot\cos\omega t$ is applied in which a direct current bias voltage Vbias2 is added to the radio-frequency voltage component which is applied to the main rod electrodes.

As just described, the direct current bias voltage applied to the pre-filter 13 is generally and conventionally constant regardless of the mass-to-charge ratio of the target ion that should be allowed to pass through. However, this has the following problem: an ion passing through the pre-filter 13 flies, as schematically illustrated in FIG. 7(*a*), while periodically oscillating with a period of $T=1/f$ [sec] for the frequency f of the radio-frequency voltage applied to the pre-rod electrodes. In the case where the frequency f is set to be constant regardless of the ion's mass-to-charge ratio, if the flight speed, i.e. the time period required to pass through the pre-filter 13, differs due to the difference of the energy that an ion has, the ion oscillation's phase at the exit of the pre-filter 13 becomes different. Generally, at the entrance of the quadrupole mass filter 14, an ion efficiently enters the quadrupole mass filter 14 in the case where the ion oscillation's phase satisfies a predetermined condition. Depending on the mass-to-charge ratio of an ion, the phase of the oscillation at the entrance of the quadrupole mass filter 14 may not satisfy the aforementioned entry condition, which causes a relatively large loss. As a result, in performing a mass scan across a predetermined mass range for example, the detection sensitivity may differ depending on the mass.

[Patent Document 1] Japanese Unexamined Patent Application Publication No. H07-240171

[Patent Document 2] Japanese Unexamined Patent Application Publication No. H11-25904

DISCLOSURE OF THE INVENTION

Problem to be Solved by the Invention

The present invention has been achieved to solve the aforementioned problem, and the objective thereof is to provide a quadrupole mass spectrometer consistently capable of performing a mass analysis with high sensitivity and accuracy by allowing an ion to be analyzed to pass through the pre-filter with high passage efficiency regardless of the mass-to-charge ratio and sending the ion into the quadrupole mass filter.

Means for Solving the Problem

To solve the previously described problem, the present invention provides a quadrupole mass spectrometer in which a multipole pre-filter composed of a plurality of pre-rod electrodes is provided in the previous stage of a quadrupole mass filter composed of a main rod electrode for selectively allowing an ion having a specific mass-to-charge ratio to pass through, including:

a) a voltage generator for applying a voltage in which a direct current bias voltage and a radio-frequency voltage are added to each pre-rod electrode of the pre-filter; and b) a controller for controlling the voltage generator in such a manner that the direct current bias voltage is changed in accordance with a mass-to-charge ratio of an ion to be allowed to pass through the pre-filter.

Effects of the Invention

The larger the mass-to-charge ratio is, the less the ion's behavior is influenced by the surrounding electric field. Hence, in the mass spectrometer according to the present invention, the direct current bias voltage applied to the pre-rod electrodes is increased with the increase of the mass-to-charge ratio of the target ion which passes through the pre-filter. Accordingly, in the case where the target ion's mass-to-charge ratio is large, the direct current electric field becomes relatively strong compared to the case where it is small. Consequently, the flight speed of an ion having a relatively large mass-to-charge ratio in passing through the pre-filter is increased, and the time period required to pass through the pre-filter is uniformed regardless of the mass-to-charge ratio. Simultaneously, the ion oscillation's phase at the exit of the pre-filter can also be uniformed. As a result, irrespective of the ion's mass-to-charge ratio, it is possible to send an ion into the quadrupole mass filter in the subsequent stage, under an appropriate entry condition, which consistently keeps the ion's passage efficiency at high levels to increase the detection sensitivity.

In principle, the direct current bias voltage may be increased as the mass-to-charge ratio of the target ion increases. However, if the absolute value of the voltage is too large, the potential barrier created by the voltage difference from the direct current bias voltage applied to the quadrupole mass filter in the subsequent stage is heightened. Then, it becomes difficult for ions to cross the potential barrier, with the result that the ion's passage efficiency is decreased rather than increased, which might decrease the detection sensitivity. In order to prevent the potential barrier from becoming high, the direct current bias voltage applied to the quadrupole mass filter can be increased as the direct current bias voltage applied to the pre-filter is increased. However, this causes the problem that the mass resolution of the quadrupole mass filter decreases.

Given these factors, in the mass spectrometer according to the present invention, the controller may preferably control the voltage generator in such a manner that the direct current bias voltage monotonically increases as the mass-to-charge ratio increases in the range equal to or less than a predetermined mass-to-charge ratio and the direct current bias voltage is kept constant in the range exceeding the predetermined mass-to-charge ratio regardless of the mass-to-charge ratio.

Ions having a large mass-to-charge ratio originally have a small oscillation amplitude because they are not likely to oscillate in a radio-frequency electric field compared to ions having a small mass-to-charge ratio. Therefore, the positional difference due to the difference of the oscillation phase at the exit of the pre-filter is not as large as that of an ion having a small mass-to-charge ratio and large oscillation amplitude. In other words, an ion having a large mass-to-charger ratio has an easy condition for entering the quadrupole mass filter, and even in the case where the ion's oscillation phase is not uniform, the loss is small. Hence, in the range exceeding a predetermined mass-to-charge ratio, even if a direct current bias voltage is kept constant regardless of the mass-to-charge ratio, the sensitivity degradation due to not satisfying the condition for entering the quadrupole mass filter is small. Rather than that, it brings about a greater effect of abating the decrease of the detection sensitivity since the potential barrier created by the voltage difference between the direct current bias voltage applied to the pre-filter and the direct current bias voltage applied to the quadrupole mass filter is kept from increasing.

As an embodiment of the mass spectrometer according to the present invention, an appropriate value of the direct current bias voltage for each mass-to-charge ratio in the range equal to or less than the predetermined mass-to-charge ratio may be obtained under the condition that the number of oscillations of an ion which passes through the pre-filter is the same, the information for the voltage control may be created based on the value, and the controller controls the voltage generator using the information.

The length of a pre-rod electrode which composes a pre-filter is structurally determined. Therefore, in the case where the frequency of the radio-frequency voltage applied to the pre-filter is constant regardless of the mass-to-charge ratio, the same number of oscillations means the same flight speed. If the direct current bias voltage applied to the pre-filter is E, the mass of an ion is m, and elementary charge is e ($=1.602\times 10^{-19}$), the ion's flight speed v is expressed by the following equation:

$$v=(2eE/m)^{1/2} \quad (1)$$

If the length of the pre-rod electrodes is L1, the time t required for an ion to pass through the pre-rod electrodes is expressed by the following equation:

$$t=L1/v=L1/(2eE/m)^{1/2}=L1\cdot(m/2eE)^{1/2} \quad (2)$$

If the frequency of the radio-frequency applied to the pre-filter is f[Hz], the number of periodic oscillations P that an ion makes while passing through the pre-rod electrode is expressed by the following equation:

$$P=f\cdot t=f\cdot L1\cdot(m/2eE)^{1/2} \quad (3)$$

Since the length L1 of the pre-rod electrodes and the frequency f are known, the relationship between the mass m and the direct current bias voltage E under the condition with a specific number of oscillations P can be computationally obtained in advance. This relationship can be regarded as the information for controlling the voltage and the value of the direct current bias voltage regarding each mass (or mass-to-charge ratio) can be determined based on the information. Alternatively, based on the information obtained by an additional actual measurement, the relationship may be corrected for example, and the value of the direct current bias voltage regarding each mass may be determined based on the corrected information. In any case, with such a manner, it is possible to easily and appropriately control the direct current bias voltage applied to the pre-filter so that the ion's passage efficiency should be at the highest or almost the highest level.

EXPLANATION OF NUMERALS

1 . . . Ionization Chamber
3 . . . Desolvation Pipe
5 . . . First Intermediate Vacuum Chamber
6 . . . First Lens Electrode
7 . . . Skimmer
8 . . . Orifice
9 . . . Second Intermediate Vacuum Chamber
10 . . . Second Lens Electrode
11 . . . Partition Wall
12 . . . Analysis Chamber
13 . . . Pre-Filter
14 . . . Quadrupole Mass Filter
15 . . . Detector
20 . . . Quadrupole Voltage Generator
21 . . . RF Voltage Generator
22 . . . DC Voltage Generator
23 . . . RF/DC Synthesizer
24 . . . Main Bias Voltage Generator
25 . . . Main Adder
26 . . . Pre-Bias Voltage Generator
27 . . . Pre-Adder
30 . . . Controller
31 . . . Voltage Control Data Memory

BEST MODE FOR CARRYING OUT THE INVENTION

Figure 1:
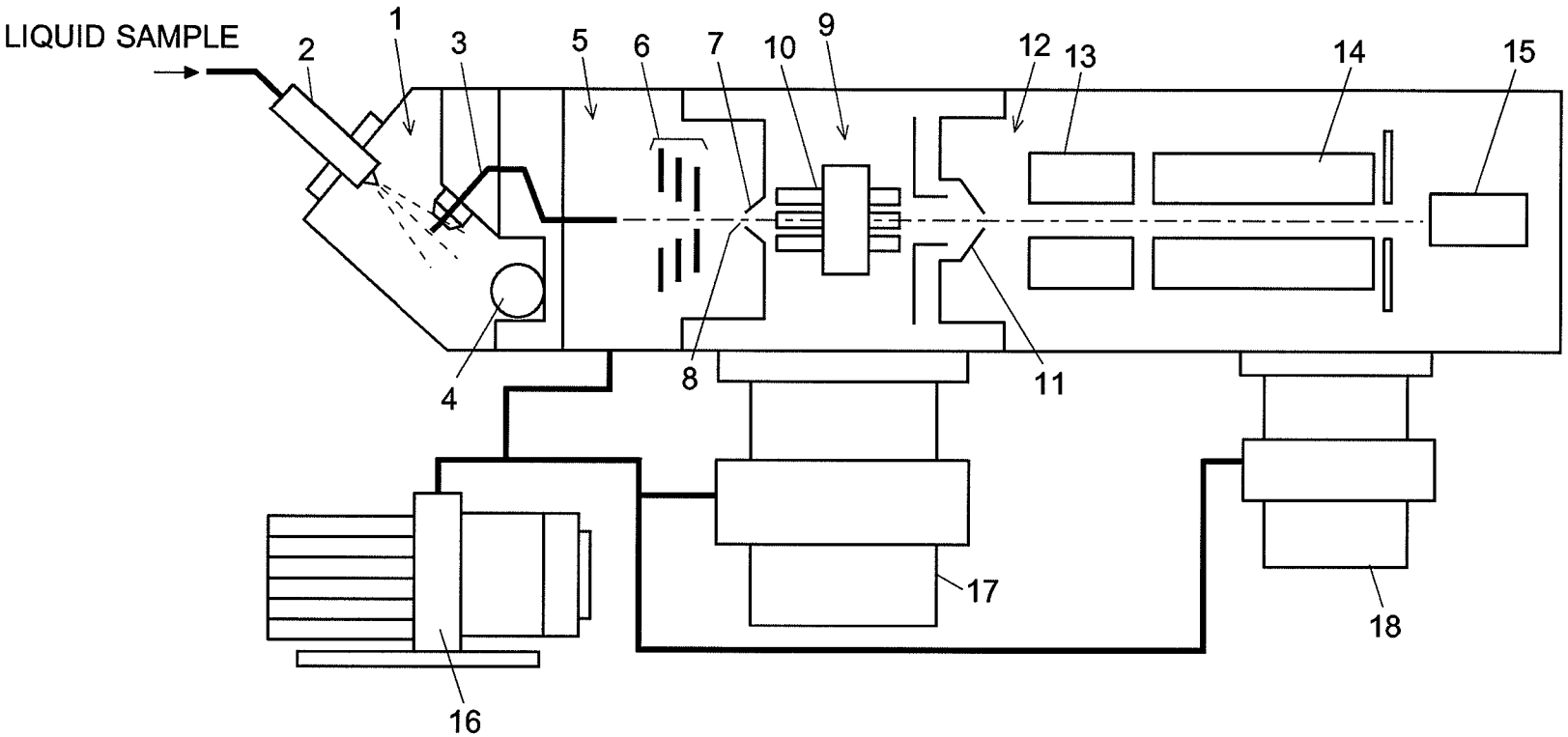
FIG. 1 is an entire configuration diagram of a quadrupole mass spectrometer according to an embodiment of the present invention.
Figure 2:
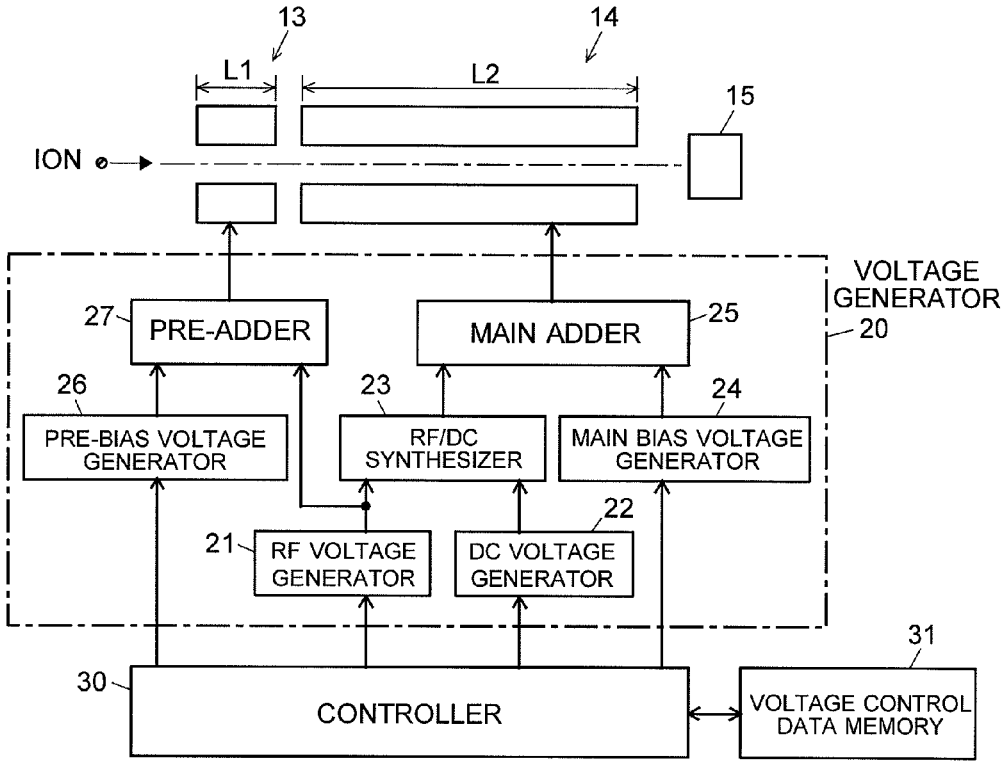
FIG. 2 is a schematic block diagram of a voltage generator of a pre-filter and quadrupole mass filter in the quadrupole mass spectrometer of the present embodiment.
Figure 3:
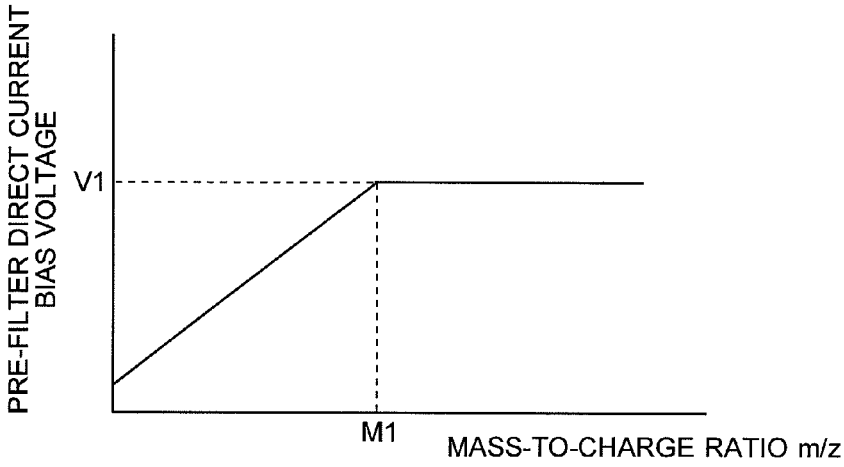
FIG. 3 is a diagram illustrating a control pattern of the direct current bias voltage of the pre-filter in the quadrupole mass spectrometer of the present embodiment.

A quadrupole mass spectrometer which is an embodiment of the present invention will be described with reference to the figures. FIG. 1 is an entire configuration diagram of the quadrupole mass spectrometer of the present embodiment, FIG. 2 is a schematic block diagram of a voltage generator of a pre-filter and quadrupole mass filter, and FIG. 3 is a diagram illustrating a control pattern of the direct current bias voltage of the pre-filter. The quadrupole mass spectrometer of the present invention is a part of a liquid chromatograph mass spectrometer (LC/MS) and an electrospray ionization method, which is one of the atmospheric chemical ionization methods, is used as an ionization unit. That is, a column outlet of a liquid chromatograph is connected in the previous stage of the configuration of FIG. 1.

In FIG. 1, a first intermediate vacuum chamber 5 and a second intermediate vacuum chamber 9, which are separated from each other by a partition wall, are provided between an ionization chamber 1 and an analysis chamber 12. In the ionization chamber 1, a nozzle 2 is provided which is connected to the end of a column outlet of a liquid chromatograph which is not shown. In the analysis chamber 12, a pre-filter 13, a quadrupole filter 14, and a detector 15 are provided. The ionization chamber 1 communicates with the first intermediate vacuum chamber 5 via a thin desolvation pipe 3, the first intermediate vacuum chamber 5 communicates with the second intermediate vacuum chamber 9 via a micro-sized passage opening (or orifice) 8 provided on top of a skimmer 7, and the second intermediate vacuum chamber 9 communicates with the analysis chamber 12 via a small aperture provided on a partition wall 11.

The inside of the ionization chamber 1 as an ion source is maintained at an atmosphere of approximate atmospheric pressure (approximately $10^5$ [Pa]) by the gaseous molecules continuously supplied from the nozzle 2, and the inside of the first intermediate vacuum chamber 5 which is the subsequent stage is vacuum-evacuated to a low vacuum atmosphere of approximately $10^2$ [Pa] by a rotary pump 16. The inside of the second intermediate vacuum chamber 9, which is the subsequent stage, is vacuum-evacuated to a medium vacuum atmosphere of approximately $10^{-1}$ through $10^{-2}$ [Pa] by a turbo molecular pump 17, and the inside of the analysis chamber 12 which is the last stage is vacuum-evacuated to a high vacuum atmosphere of approximately $10^{-3}$ through $10^{-4}$ [Pa] by another turbo molecular pump 18. That is, a multistage differential pumping system is used in which the degree of vacuum is increased at each chamber in a stepwise manner from the ionization chamber 1 toward the analysis chamber 12, in order to keep the inside of the analysis chamber 12, which is the last stage, in a high vacuum state.

Although each structure is different from each other, an ion optical system for efficiently transporting an ion to the subsequent stage is respectively provided inside the first intermediate vacuum chamber 5 and inside the second intermediate vacuum chamber 9. That is, inside the first intermediate vacuum chamber 5, a first lens electrode 6 composed of slantly arranged three rows of plate electrodes, each row consisting of a plurality (four) of the plate electrodes, and the electric field formed by the electrode 6 helps the draw of the ions via the desolvation pipe 3 and converges the ions into the vicinity of the orifice 8 of the skimmer 7. Inside the second intermediate vacuum chamber 9, an octapole-type second lens electrode 10 in which eight rod electrodes are arranged in order to surround the ion optical axis C is provided. This converges an ion and sends it into the analysis chamber 12.

Inside the analysis chamber 12, the quadrupole mass filter 14 is provided in such a manner that four main rod electrodes whose length is L2 internally touch a cylinder having a predetermined radius centering on the ion optical axis C. Although not shown, the main rod electrodes are connected in such a manner that two main rod electrodes facing across the ion optical axis C make a pair. Different voltages are applied to the main rod electrodes neighboring in the circumferential direction. The pre-filter 13 provided in the previous stage of the quadrupole mass filter 14 is composed of four pre-rod electrodes having the length of L1 which is shorter than that of the main rod electrodes. As in the main rod electrodes, the pre-rod electrodes are connected in such a manner that two electrodes facing across the ion optical axis C make a pair.

A quadrupole voltage generator 20 for applying voltages to the pre-filter 13 and the quadrupole mass filter 14 includes: an RF voltage generator 21 for generating a radio-frequency voltage $V \cdot \cos \omega t$ under the control of a controller 30; a DC voltage generator 22 for generating a direct current voltage U under the control of the controller 30; a main bias voltage generator 24 for generating a direct current bias voltage Vbias1 for the quadrupole mass filter 14 under the control of the controller 30; a pre-bias voltage generator 26 for generating a direct current bias voltage Vbias2 for the pre-filter 13 under the control of the controller 30; an RF/DC synthesizer 23 for synthesizing (i.e. superimposing or adding) the radio-frequency voltage $V \cdot \cos \omega t$ and the direct current voltage U; a main adder 25 for adding the synthesized voltage of $\pm(U+V \cdot \cos \omega t)$ and the direct current bias voltage Vbias1; and a pre-adder 27 for adding the radio-frequency voltage of $\pm V \cdot \cos \omega t$ and the direct current bias voltage Vbias2. The quadrupole voltage generator 20 applies the voltage of Vbias1$\pm(U+V \cdot \cos \omega t)$ to the quadrupole mass filter 14, and also applies the voltage of Vbias2$\pm V \cdot \cos \omega t$ to the pre-filter 13. The controller 30 controls, by using the control data stored in a voltage control data memory 31, each of the voltages generated by the RF voltage generator 21, DC voltage generator 22, main bias voltage generator 24, and pre-bias voltage generator 26.

In performing a mass scan in order that the mass-to-charge ratio of ions that reach the detector 15 through the quadrupole mass filter 14 should change from Mmin to Mmax (where Mmin<Mmax), generally, the voltage applied to the quadrupole mass filter 14 is scanned in such a manner that U and V are changed in accordance with the mass with U/V kept constant. This scan operation is also accompanied by a change in the radio-frequency voltage $V \cdot \cos \omega t$ applied to the pre-filter 13. However, the direct current bias voltage Vbias2 which is added to the radio-frequency voltage in the pre-adder 27 conventionally has been kept constant. On the other hand, in the mass spectrometer of the present embodiment, as its characteristic control, the direct current bias voltage Vbias2 is also changed in accordance with the mass-to-charge ratio of the target ion to be allowed to pass through the pre-filter 13. In this regard, a detailed explanation will be provided.

Figure 4:
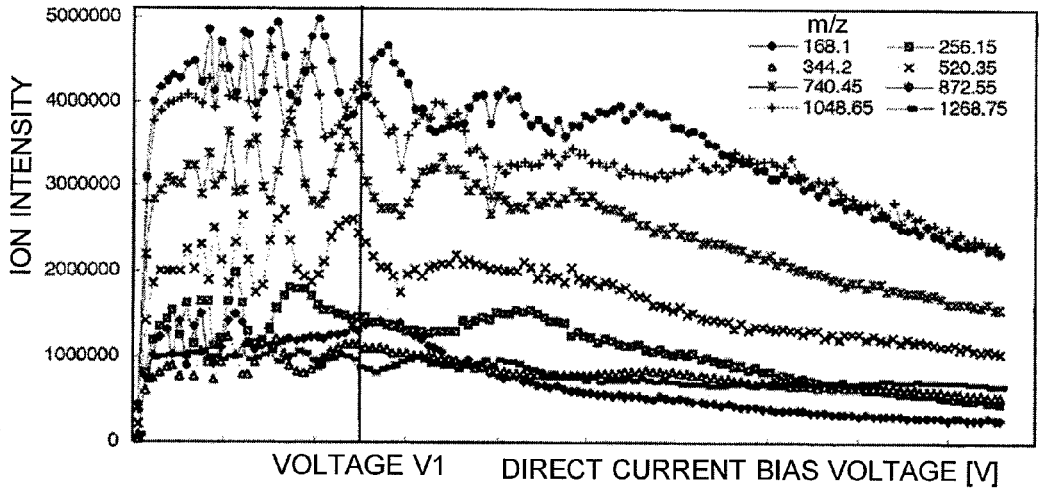
FIG. 4 is a diagram illustrating a measurement result of the fluctuation of the ion intensity in the case where the direct current bias voltage of the pre-filter is changed.
Figure 7:
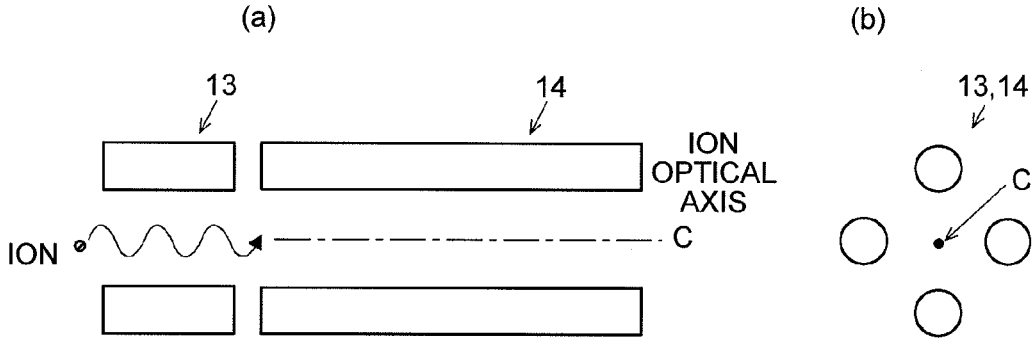
FIG. 7 illustrates the schematic diagrams of a pre-filter and a quadrupole mass filter: (a) is an arrangement diagram on a plane including an ion optical axis C, and (b) is an arrangement diagram on a plane orthogonal to the ion optical axis.

FIG. 4 is a diagram illustrating the result of an actual measurement of the ion intensity, for each of a plurality of ions having different mass-to-charge ratios, in the case where the direct current bias voltage applied to the pre-filter 13 is changed. This result shows that the ion intensity periodically fluctuates with the increase of the direct current bias voltage. That is, as previously described, an ion passing through the pre-filter 13 oscillates by the radio-frequency electric field formed by the radio-frequency voltage $V \cdot \cos \omega t$ applied to the pre-filter 13 (refer to FIG. 7(*a*)). By changing the direct current bias voltage, the phase of the oscillation at the exit of the pre-filter 13 (or at the entrance of the quadrupole mass filter 14) is changed. This change is accompanied by a change in the entry efficiency into the quadrupole mass filter 14, which leads to the aforementioned fluctuation in the ion intensity.

This result also shows that the value of the direct current bias voltage which gives the largest ion intensity differs depending on the mass-to-charge ratio. In other words, the previously described periodical behavior of the ion is affected by the ion's mass-to-charge ratio and the direct current bias voltage. Furthermore, it is also understood that, after the direct current bias voltage is increased to some extent, the ion intensity for every mass-to-charge ratio shows a general tendency to decrease. This is because, as previously described, it is difficult for ions to cross the potential barrier created by the voltage difference between the direct current bias voltage Vbias2 which is applied to the pre-filter 13 and the direct current bias voltage Vbias1 which is applied to the quadrupole mass filter 14 in the subsequent stage.

Figure 5:
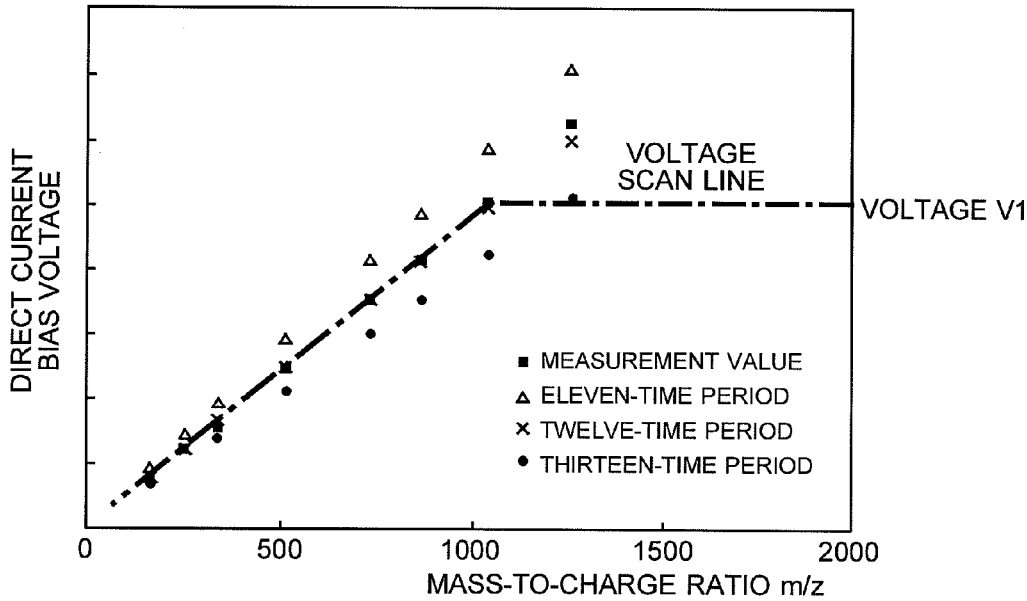
FIG. 5 is a diagram illustrating the relationship among the number of oscillation period calculated from the frequency of the radio-frequency voltage applied to the pre-filter, mass-to-charge ratio, and direct current bias voltage.

FIG. 5 is a diagram illustrating the relationship between the mass-to-charge ratio and the direct current bias voltage, calculated for each number of oscillations (or oscillation period) that an ion makes while passing through the pre-filter 13 obtained by the frequency f of the radio-frequency voltage $V \cdot \cos \omega t$ and the length L1 of the pre-rod electrodes. In this figure, the actual measurement values of the direct current bias voltage which gives the largest ion intensity at each mass-to-charge ratio are also plotted. This result shows the positive agreement between the calculation result of twelve oscillations (or twelve-time period) and the measurement result. It is understood that the mass-to-charge ratio and the direct current bias voltage have the relationship of linear increase (i.e. proportional relationship). Therefore, it is possible to attain the highest or almost the highest ion intensity by determining the value of the direct current bias voltage Vbias2 in such a manner that the number of oscillations that an ion makes while passing through the pre-filter 13 should be twelve regardless of the mass-to-charge ratio.

Figure 6:
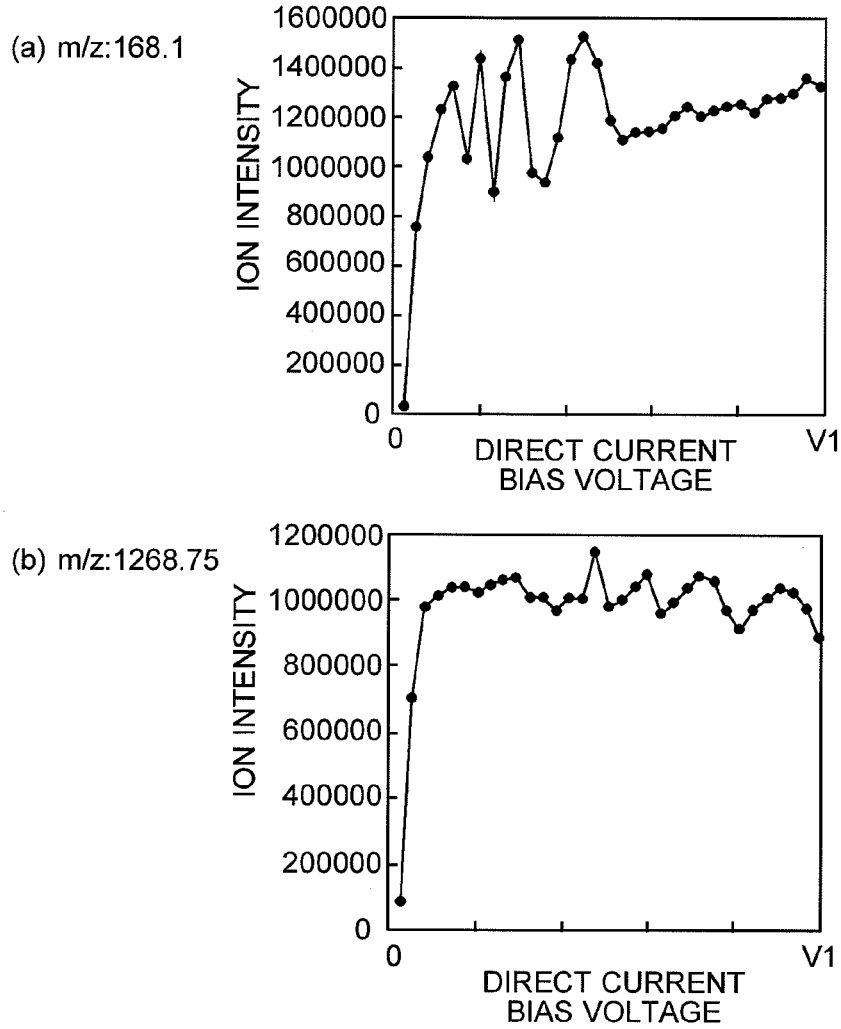
FIG. 6 illustrates the diagrams showing an example of the relationship between the ion intensity and the direct current bias voltage.

However, if the direct current bias voltage is increased equal to or more than some degree (voltage V1 in the result of FIG. 4) as previously described, the ion intensity decreases by the influence of the potential barrier. On the other hand, since an ion having such a large mass-to-charge ratio (approximately more than m/z1000 in this embodiment) that requires equal to or more than V1 in the relation of linear increase as previously described is not originally likely to oscillate (refer to FIG. 6), the ion intensity's fluctuation in accordance with the change of the direct current bias voltage is also relatively small. In other words, in the case of the ions whose range of the mass-to-charge ratio is considerably large, although the ion intensity may be improved when the direct current bias voltage is equal to or more than V1, the degree of the improvement is not that significant. Therefore, if the direct current bias voltage is kept at V1, there is no practical problem. Given this factor, in this embodiment, the relationship of the polygonal line indicated with an alternate long and short dash line in FIG. 5 is used as the appropriate value of the direct current bias voltage in accordance with the mass-to-charge ratio.

That is, as illustrated in FIG. 3, in the mass range equal to or less than the mass-to-charge ratio M1, the mass-to-charge ratio and direct current bias voltage have the relationship of a linear monotonic increase, and in the range exceeding the mass-to-charge ratio M1, the direct current bias voltage is maintained at V1 regardless of the mass-to-charge ratio. Since such a relationship can be previously obtained by an experiment and computation, the control data such as a formula or table which presents this relationship is stored in the voltage control data memory 31, so that the direct current bias voltage Vbias2 can be obtained for a given mass-to-charge ratio.

In performing an actual analysis by a mass scan, the controller 30 uses the aforementioned control data stored in the voltage control data memory 31 to obtain a voltage value in accordance with each mass-to-charge ratio, and controls the RF voltage generator 21, DC voltage generator 22, main bias voltage generator 24, and pre-bias voltage generator 26. Accordingly, when an ion passes through the pre-filter 13 and is introduced into the quadrupole mass filter 14, the target ion to be analyzed enters the quadrupole mass filter 14 with high efficiency, and only the target ion is selectively allowed to pass through the quadrupole mass filter 14 and reach the detector 15. Therefore, it is possible to detect an ion with high sensitivity regardless of the mass-to-charge ratio.

Basically, the control data stored in the voltage control data memory 31 can be used intact in the determination of the value of the direct current bias voltage to be applied to the pre-filter 13. However, the relationship between the mass-to-charge ratio and the optimum direct current bias voltage might slightly change because of, for example, the progression of the taint on the surface of the pre-filter 13, or the change of the pre-filter 13's attachment dimensions (e.g. the distance from the quadrupole mass filter 14) due to a repair or other factors. In such cases, the relationship based on the control data stored in the voltage control data memory 31 may preferably be corrected based on the result of an actual measurement of a standard sample for example, and the voltage control may be performed using the corrected result. The preliminary provision of such a function enables an analysis with higher sensitivity.

In the aforementioned embodiment, the pre-filter 13 composed of four pre-rod electrodes is provided in the vicinity of the previous stage of the quadrupole mass filter 14. However, a multipole configuration with more than four pre-rod electrodes may be adopted, such as six or eight pre-rod electrodes. That is, the present invention is also applicable to the case where a multipole radio-frequency ion guide is provided immediately anterior to the quadrupole mass filter 14. In addition, it should be noted that the aforementioned embodiment is an example of the present invention, and that, also in other aspects, it is evident that any modification, addition, or adjustment appropriately made within the spirit of the preset invention is also covered by the claims of the present patent application.

The invention claimed is:

1. A quadrupole mass spectrometer, comprising a high vacuum analysis chamber;

a quadrupole mass filter composed of a main rod electrode for selectively allowing an ion having a specific mass-to-charge ratio to pass through;

a multipole pre-filter composed of a plurality of pre-rod electrodes that introduce ions to the quadrupole mass filter, wherein the quadrupole mass filter and the multipole pre-filter are provided in the analysis chamber;

a voltage generator for applying a first direct current bias voltage and a radio-frequency voltage to each pre-rod electrode of the pre-filter and applying a second direct current bias voltage and the same radio frequency voltage to the quadrupole mass filter, the first direct current bias voltage and the second direct current bias voltage being different; and a controller for controlling the voltage generator in such a manner that the first direct current bias voltage is changed in accordance with a mass-to-charge ratio of an ion to be allowed to pass through the pre-filter, wherein the first direct current bias voltage is the same for all pre-rod electrodes.

2. The quadrupole mass spectrometer according to claim 1, wherein the controller controls the voltage generator in such a manner that the first direct current bias voltage monotonically increases as the mass-to-charge ratio increases in a range equal to or less than a predetermined mass-to-charge ratio and the first direct current bias voltage is kept constant in a range exceeding the predetermined mass-to-charge ratio regardless of the mass-to-charge ratio.

3. The quadrupole mass spectrometer according to claim 2, wherein an appropriate value of the first direct current bias voltage for each mass-to-charge ratio in the range equal to or less than the predetermined mass-to-charge ratio is obtained under a condition that a number of oscillations of an ion which passes through the pre-filter is a same, information for a voltage control is created based on the value, and the controller controls the voltage generator using the information.

4. The quadrupole mass spectrometer according to claim 1, further comprising:

a intermediate vacuum chamber; and a lens electrode;

the lens electrode is provided in the intermediate vacuum chamber and converges the ions and send them to the high vacuum analysis chamber.

* * * * *